US010422091B1

(12) United States Patent
Moir

(10) Patent No.: US 10,422,091 B1
(45) Date of Patent: Sep. 24, 2019

(54) PORTABLE RETRACTABLE BARRIER APPARATUS

(71) Applicant: Michelle L. Moir, Sioux Falls, SD (US)

(72) Inventor: Michelle L. Moir, Sioux Falls, SD (US)

( * ) Notice: Subject to any disclaimer, the term of this patent is extended or adjusted under 35 U.S.C. 154(b) by 548 days.

(21) Appl. No.: 15/196,886

(22) Filed: Jun. 29, 2016

(51) Int. Cl.

| | |
|---|---|
| ***E01F 13/02*** | (2006.01) |
| ***E04H 17/16*** | (2006.01) |
| ***E04H 17/18*** | (2006.01) |
| ***E04H 17/20*** | (2006.01) |
| ***B65H 75/40*** | (2006.01) |

(52) U.S. Cl.
CPC ..... *E01F 13/028* (2013.01); *B65H 75/40* (2013.01); *E01F 13/022* (2013.01); *E04H 17/161* (2013.01); *E04H 17/18* (2013.01); *E04H 17/20* (2013.01)

(58) Field of Classification Search
CPC ..... E01F 13/022; E01F 13/028; E04H 17/18; E04H 17/20; E04H 17/161; B65H 75/40; E06B 9/08; E06B 9/42; E06B 9/17007; E06B 2009/002
USPC ..... 256/24, 65.14; 160/23.1, 24, 351
See application file for complete search history.

(56) References Cited

U.S. PATENT DOCUMENTS

| | | | | |
|---|---|---|---|---|
| 1,968,720 A | | 7/1934 | Staff | |
| 3,938,806 A | | 2/1976 | Husbands | |
| 4,088,317 A | | 5/1978 | Gierla | |
| 4,135,716 A | | 1/1979 | Ginsburg | |
| 4,838,440 A | * | 6/1989 | Thompson | A47B 3/0809 108/125 |
| 4,913,428 A | | 4/1990 | Nauman | |
| 4,979,754 A | | 12/1990 | Eisenhart | |
| 5,054,507 A | | 10/1991 | Sparks | |
| 5,220,740 A | * | 6/1993 | Brault | F16M 11/42 248/910 |
| 6,142,701 A | * | 11/2000 | Falcon | E01F 13/028 160/24 |
| 6,375,164 B1 | * | 4/2002 | Siegler | E01F 13/028 256/1 |
| 6,672,017 B2 | * | 1/2004 | Larson | A47B 91/00 248/519 |

(Continued)

FOREIGN PATENT DOCUMENTS

| | | |
|---|---|---|
| WO | 0053459 | 9/2000 |

*Primary Examiner* — Amber R Anderson
*Assistant Examiner* — Nahid Amiri
(74) *Attorney, Agent, or Firm* — Jeffrey A. Proehl; Woods, Fuller, Shultz & Smith, PC

(57) ABSTRACT

A portable retractable barrier apparatus may comprise a primary standard and a secondary standard for positioning on a ground surface. Each standard may include a base portion with the base portion of at least one of the standards having a slot, and a post portion mounted on the base portion. A barrier may have a first end mounted on the primary standard and a second end mounted on the secondary standard. A retraction structure may be configured to retract the barrier with respect to the primary standard and may include a spool with the barrier at least partially wrapped about the spool. The slot in the base portion of one standard being configured to receive the post portion of the other standard so that the base portion of said at least one standard is restable upon the base portion of said other standard.

19 Claims, 3 Drawing Sheets

(56) References Cited

U.S. PATENT DOCUMENTS

| | | | | |
|---|---|---|---|---|
| 6,733,204 | B1 * | 5/2004 | Paniccia | E01F 7/06 160/238 |
| 6,807,999 | B1 * | 10/2004 | Bowen | E01F 13/028 160/24 |
| 7,219,709 | B1 * | 5/2007 | Williams | E01F 13/028 160/24 |
| 8,261,806 | B2 * | 9/2012 | Wettern | E01F 13/028 160/24 |
| 8,365,798 | B2 * | 2/2013 | Feldpausch | A47G 5/00 160/135 |
| 8,573,417 | B1 * | 11/2013 | Anderson | D06F 53/045 211/119.01 |
| 8,991,470 | B1 * | 3/2015 | Pacheco | G08B 3/00 160/240 |
| 9,433,308 | B1 * | 9/2016 | Kalinski | E06B 9/40 |
| D807,311 | S * | 1/2018 | Lee | D14/126 |
| 2007/0087869 | A1 | 4/2007 | Lin | |
| 2007/0176158 | A1 * | 8/2007 | Robinson | E01F 13/028 256/12.5 |
| 2009/0294078 | A1 * | 12/2009 | Feldpausch | A47G 5/00 160/377 |
| 2010/0181544 | A1 * | 7/2010 | Wettern | E01F 13/028 256/73 |

* cited by examiner

PORTABLE RETRACTABLE BARRIER APPARATUS

BACKGROUND

Field

The present disclosure relates to barrier devices and more particularly pertains to a new portable retractable barrier apparatus for providing a temporary movable barrier.

SUMMARY

In one aspect, the present disclosure relates to a portable retractable barrier apparatus comprising a pair of standards for positioning on a ground surface, with the standards comprising a primary standard and a secondary standard. Each of the standards may include a base portion, with the base portion of at least one of the standards having a slot extending into the base portion from a perimeter of the base portion, and a post portion being mounted on the base portion and extending upwardly from the base portion. The apparatus may also include a barrier mounted on the standards with a first end of the barrier being mounted on the primary standard and a second end of the barrier being mounted on the secondary standard. The apparatus may also include a retraction structure configured to retract the barrier with respect to the primary standard, and the retraction structure may include a spool rotatably mounted on one of the standards. The first end of the barrier may be mounted on the spool and at least partially wrapped about the spool. The slot in the base portion of the at least one standard may be configured to receive the post portion of an other standard so that the base portion of said at least one standard is restable upon the base portion of said other standard.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
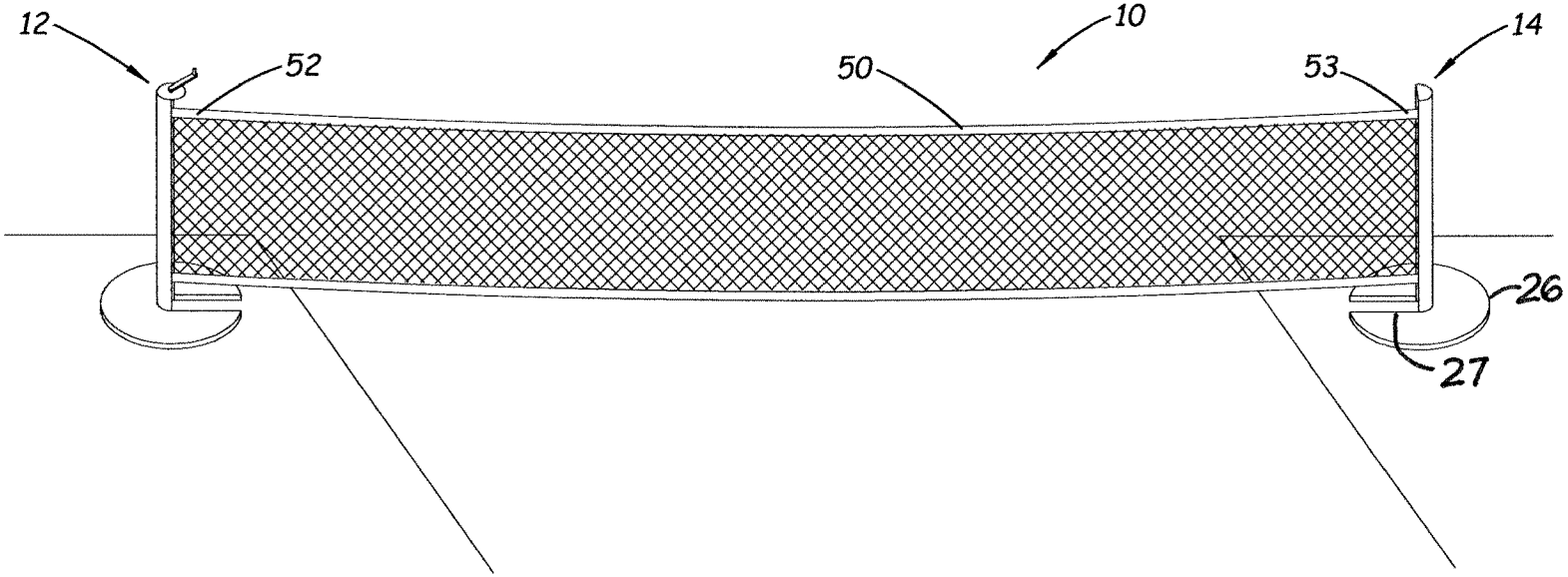
FIG. 1 is a schematic perspective view of a new portable retractable barrier apparatus according to the present disclosure.
Figure 2:
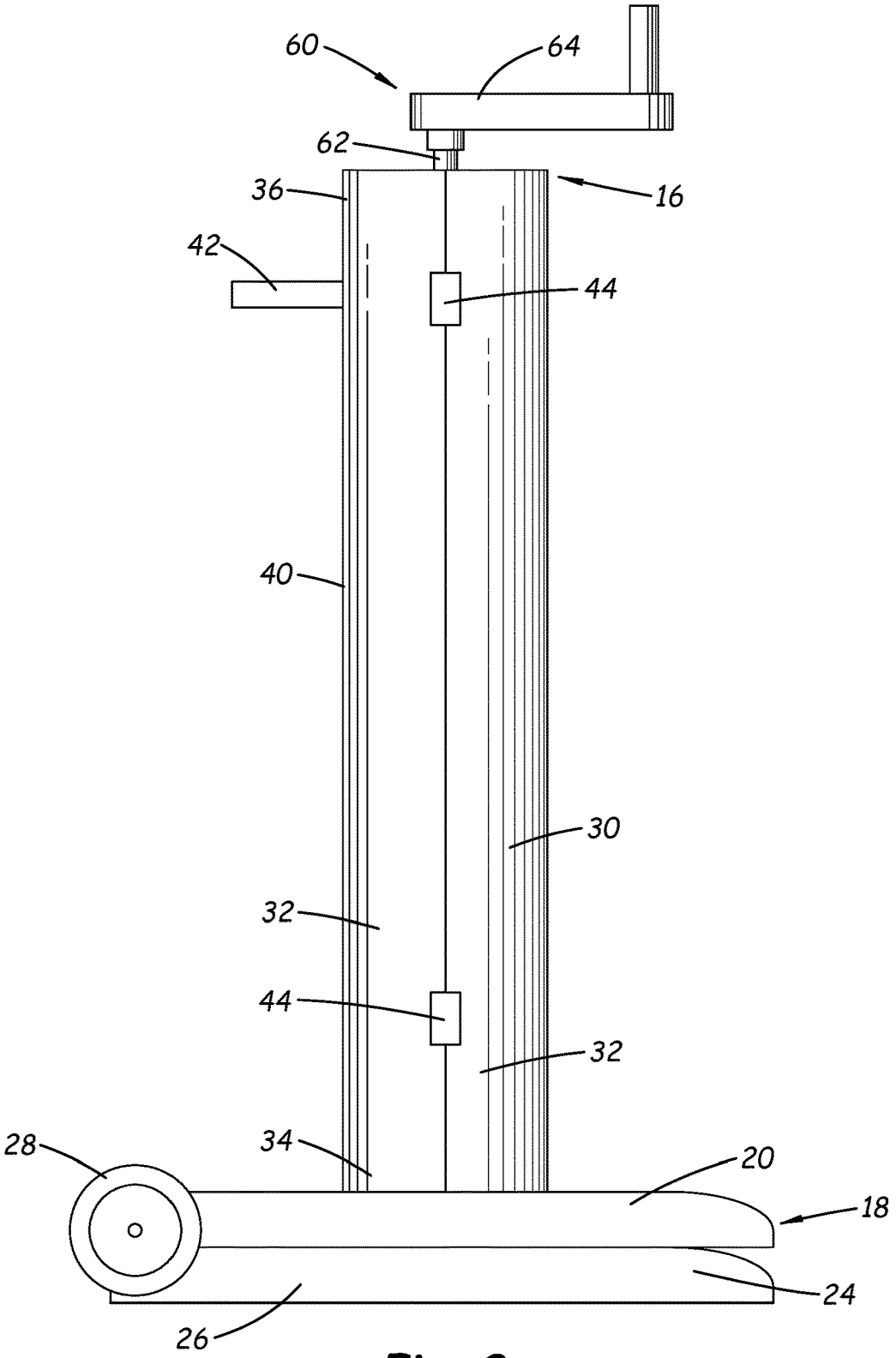
FIG. 2 is a schematic side view of the primary and secondary standards, according to an illustrative embodiment.
Figure 3:
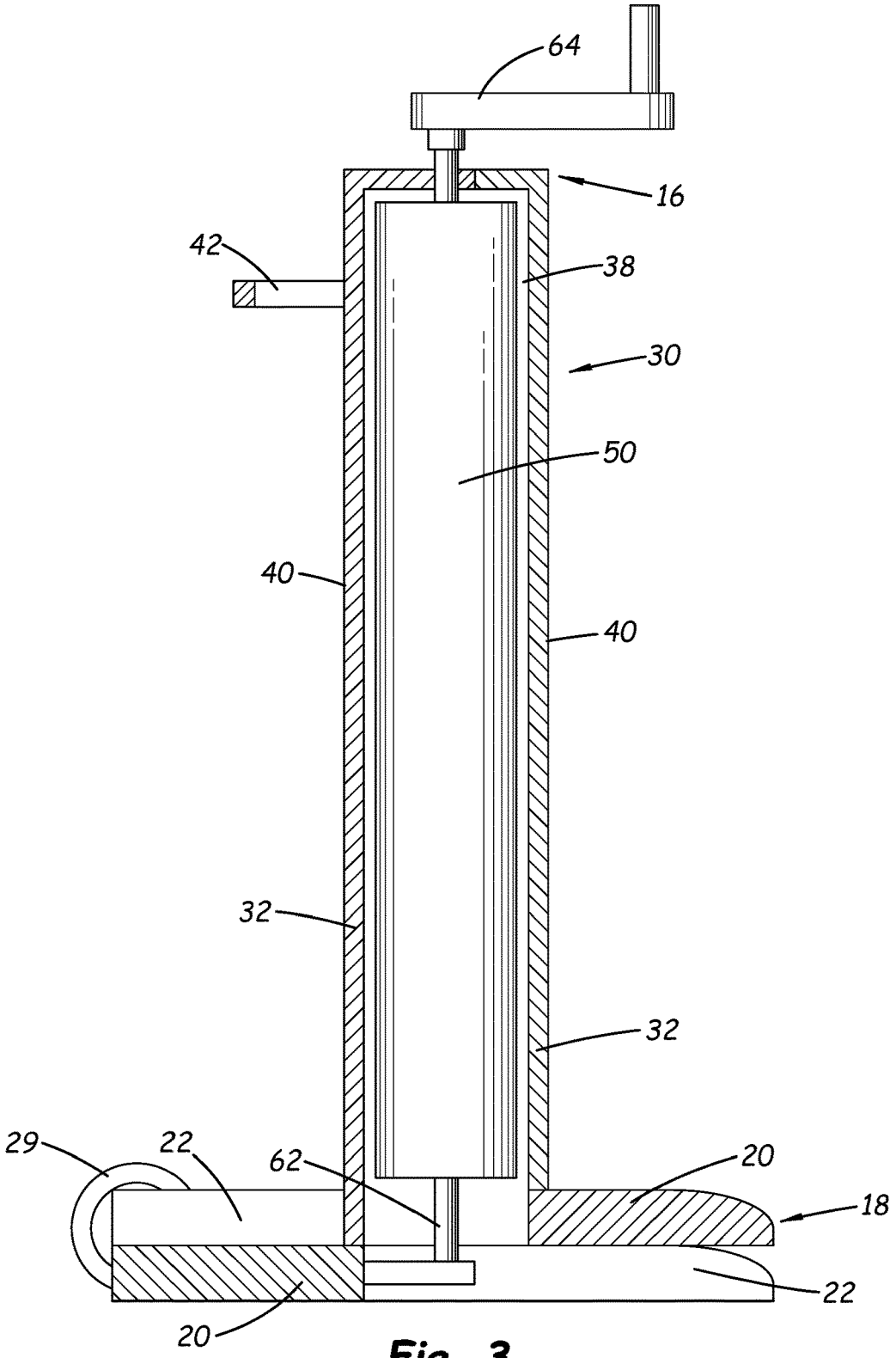
FIG. 3 is a schematic side sectional view of the standards, according to an illustrative embodiment.

With reference now to the drawings, and in particular to FIGS. 1 through 3 thereof, a new portable retractable barrier apparatus embodying the principles and concepts of the disclosed subject matter will be described.

The disclosure relates to a portable retractable barrier apparatus 10 that may be suitable to form a barrier or obstruction across a space between two points. Illustratively, the space may be a driveway and the points may be locations on either side of the driveway, although those of ordinary skill in the art will recognize that the apparatus 10 will be suitable for a variety of other applications.

In general, the barrier apparatus 10 may include a pair of standards 12, 14 for positioning on a ground surface at points between which the space is sought to be obstructed by the barrier apparatus 10. For the purpose of this description, one of the standards will comprise a primary standard 12 and the other standard will comprise a secondary standard 14, and the standards may have features in common but may also have differences. Each of the standards 12, 14 has a top 16 and a bottom 18, with the bottom being positionable on the ground surface and the top being located a distance above the ground surface. Each of the standards may include a base portion 20 and a post portion 30 which is mounted on the base portion and extends in a generally vertically upward orientation from the base portion. In greater detail, the base portion 20 of at least one of the standards 12, 14 may have a slot 22 which extends toward a center of the base portion, and in some embodiments of the apparatus 10 both standards may have a slot 22. Each of the base portions 20 may have a perimeter 24 and the perimeter may include a circular portion 26. The perimeter 24 of the standard or standards may have a slot portion 27 which defines the slot 22 in the base portion.

In some embodiments, at least one wheel 28 may be mounted on the base portion of one of the standards 12, 14, and may be mounted on the primary standard. In some of the more preferred embodiments, a pair of wheels 28, 29 may be mounted on the base portion of the standard. The pair of wheels 28, 29 may be spaced from each other and may be rotatable about substantially the same axis. The wheel or wheels may be positioned generally outside of the perimeter 24 of the base portion in a manner such that the wheels do not contact the ground surface when the post portion of the standard is in s substantially vertically upright orientation, but the wheels may be moved into contact with the ground surface when the post portion is tipped out of the upright orientation.

The post portion 30 of each of the standards 12, 14 may include a partial housing 32 which may have a lower end 34 which is attached to the base portion and an upper end 36 which is located opposite of the lower end. The partial housing 32 of one standard 12 may be configured to be received in the slot 22 of the base portion of the other standard 14 such that the partial housings of the standards move toward each other and together to combine to form a substantially enclosed housing with an interior 38. The partial housing of the post portion may be positioned adjacent to the slot 22 in the base portion of the standard, and may be oriented relative to the slot such that the partial housing opens toward the slot and the slot extends into a section of the interior of the partial housing. The partial housing 32 may be formed by a wall 40 and in some embodiments the wall may have a substantially semi-cylindrical configuration. The wall 40 of the post portion of the primary standard 12 may form a tubular housing with the wall 40 of the post portion of the secondary standard, and the housing may be cylindrical. A handle 42 for maneuvering the apparatus 10 during movement may be mounted on one of the partial housings of the standards, and may be located toward the upper end 36 of the respective partial housing. In some embodiments, the handle may be mounted on the partial housing of the primary standard 12. A securing device 44 or devices may be mounted on at least one of the partial housings of the standards to releasably secure the partial housings together and thereby secure the standards together in a nested condition. The securing device may comprise any suitable releasable securing device, such as, for example, a latch or buckle or snap fitting.

The slot 22 in the base portion in the primary standard may be configured to receive the post portion of the secondary standard so that the base portion of the secondary standard may be rested on the base portion of the primary standard in a stacked configuration. The base portion of the primary standard may thus provide support for the base portion (as well as the post portion) of the secondary standard. In embodiments in which a wheel or wheels are mounted on the base portion of the primary standard, the primary standard and the secondary standard may be moved as a unit on the wheels for transport across the ground surface.

The retractable barrier apparatus 10 may also include a barrier 50 which is mounted on at least one of the standards 12, 14. The barrier 50 may have opposite ends 52, 53, with a first end 52 being mounted on the primary standard and a second end 53 being mounted on the secondary standard. The barrier may have a vertical width that is similar to the height of the post portions of the standards. At least a portion of the barrier 40 may comprise a flexible material, which may facilitate the retraction of the barrier into the post portion of the standard. Other portions of the barrier may be relatively more rigid, such as the portions along the upper and lower edges of the barrier. The barrier may also comprise a reticulated net or mesh material with openings able to let moving air or wind pass through the barrier, although closer weaves of material may be utilized. Other embodiments may utilize one or more straps or cords extending between the ends. It should be recognized that other suitable types of barriers may also be utilized, and that the structure utilized to form the barrier may not form a complete barrier to movement, but a means of detecting movement across a boundary defined between the standards, such as by breaking a field formed by motion sensors, light beam or laser transmitters and detectors, and the like that may be used to, for example, trigger an audible or visual or remote alarm.

The barrier apparatus 10 may also include a retraction structure 60 which is configured to retract the barrier with respect to one of the standards, and may be mounted on the primary standard 12 to retract the barrier to the primary standard. The retraction structure 60 may comprise a spool 62 which is rotatably mounted on the standard, and the first end 52 of the barrier may be mounted on the spool. The barrier 50 may be at least partially wrapped about the spool and rotation of the spool may cause additional portions of the barrier 50 to be wrapped about the spool until the barrier is substantially entirely wrapped about the spool. The second end 53 of the barrier may be mounted to the post portion 30 of the secondary standard 14, and illustratively may be attached to an inward surface of the partial housing 32 of the standard 14. The spool 62 may extend along the post portion 30 of the primary standard 12, and may be positioned in the interior 38 of the enclosed housing formed by the partial housings 32 of the post portions of the standards when the partial housings are brought together. The spool 62 may be at least partially positioned in the partial housing of the post portion of the primary standard. The retraction structure 60 may also include a crank handle 64 which may be mounted on the spool to rotate with the spool such that rotating the handle 64 causes rotation of the spool. The crank handle 64 may extend from the post portion of the primary standard, and may extend from the upper end 36 of the partial housing 32.

In use, the nested primary and secondary standards may be moved on the wheels to a suitable location by tipping or tilting the standards to bring the wheels into contact with the ground, and then rolling the standards to a location where the primary standard is to be located, such as one side of a driveway to be obstructed. The secondary standard may be pulled away from the primary standard so that the barrier attached to the secondary standard is unwound from the spool on the primary standard. The secondary standard may then be moved to the desired location for the other end of the barrier, such as the opposite side of the driveway. After use, the crank handle may be rotated to retract the barrier onto the spool on the primary standard until the secondary standard is brought into proximity of the primary standard, and the base portion of the secondary standard may be stacked on the base portion of the primary standard by moving the post portion of the primary standard into the slot of the secondary standard. The partial housings may be moved into proximity to each other, and may be abutted against each other, to enclose the spool and the spooled barrier in the interior of the housing formed by the partial housings.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A portable retractable barrier apparatus comprising:

a pair of standards for positioning on a ground surface, the standards comprising a primary standard and a secondary standard, each of the standards including:

a base portion having a perimeter; and a post portion having a lower end mounted on the base portion such that the post portion extends upwardly from the base portion;

a barrier mounted on the standards with a first end of the barrier being mounted on the primary standard and a second end of the barrier being mounted on the secondary standard; and a retraction structure configured to retract the barrier with respect to the primary standard, the retraction structure including a spool rotatably mounted on one of the standards, the first end of the barrier being mounted on the spool and at least partially wrapped about the spool;

wherein the base portion of a first one of the primary and secondary standards has a slot with a length extending from the perimeter of the base portion to a location of the post portion mounted on the base portion of the first standard, the slot having a width measured substantially perpendicular to the length of the slot;

wherein the width of the slot in the base portion of the first standard is uniform along the length of the slot from the perimeter of the base portion to the location of the post portion to receive the lower end of the post portion of so that the base portion of first standard is stackable upon the base portion of a second one of the primary and secondary standards.

2. The apparatus of claim 1 wherein the slot is formed in the base portion of the secondary standard and the base portion of the secondary standard is restable on the base portion of the primary standard.

3. The apparatus of claim 1 wherein the retraction structure further includes a crank handle being mounted on the spool to rotate with the spool.

4. The apparatus of claim 1 wherein at least one wheel is mounted the base portion of one of the standards.

5. The apparatus of claim 4 wherein the at least one wheel comprises a pair of wheels mounted on the base portion of the one said standard.

6. The apparatus of claim 1 wherein the barrier comprises a reticulated net.

7. The apparatus of claim 1 wherein the post portion of each of the standards includes a partial housing, the partial housing of one of the standards being configured to be received in the slot of the base portion of the other one of the standards such that the partial housing of one of the standards meets together with the partial housing of the other one of the standards to form a substantially enclosed housing with an interior.

8. The apparatus of claim 7 wherein the partial housing of the post portions of each of the standards is formed by a semi-cylindrical wall, the semi-cylindrical wall of the partial housing of the post portion of the primary standard and the semi-cylindrical wall of the partial housing of the post portion of the secondary standard forming a substantially cylindrical housing.

9. The apparatus of claim 7 wherein a handle is mounted on one of the partial housings of the standards.

10. The apparatus of claim 7 wherein a securing device is mounted on the partial housing of at least one of the post portion of at least one of the standards to releasably secure the partial housings of the post portions of the standards together.

11. The apparatus of claim 1 wherein at least a portion of the barrier is flexible.

12. The apparatus of claim 1 wherein the uniform width of the slot in the base portion of the first standard is substantially equal to a width of the lower end of the post portion.

13. The apparatus of claim 1 wherein the perimeter of each of the base portions of the standards has a circular shape and the slot in the base portion of the first standard extends radially outwardly from the location of the post portion to the perimeter.

14. The apparatus of claim 1 wherein the base portion has an upper surface and a lower surface, the width of the slot being uniform between the upper and lower surfaces of the base portion of the first standard.

15. The apparatus of claim 1 wherein the uniform width of the slot in the base portion of the first standard is substantially equal to a width of the lower end of the post portion;

wherein the perimeter of each of the base portions of the standards has a circular shape and the slot in the base portion of the first standard extends radially outwardly from the location of the post portion to the perimeter;

wherein the base portion has an upper surface and a lower surface, the width of the slot being uniform between the upper and lower surfaces of the base portion of the first standard;

wherein the slot is formed in the base portion of the secondary standard and the base portion of the secondary standard is restable on the base portion of the primary standard;

wherein a pair of wheels are mounted the base portion of the primary standard; and wherein the barrier comprises a reticulated net with at least a portion of the barrier being flexible.

16. A portable retractable barrier apparatus comprising:

a pair of standards for positioning on a ground surface, the standards comprising a primary standard and a secondary standard, each of the standards including:

a base portion, the base portion of a first one of the primary and secondary standards having a slot extending into the base portion from a perimeter of the base portion; and a post portion being mounted on the base portion and extending upwardly from the base portion;

a barrier mounted on the standards with a first end of the barrier being mounted on the primary standard and a second end of the barrier being mounted on the secondary standard; and a retraction structure configured to retract the barrier with respect to the primary standard, the retraction structure including a spool rotatably mounted on one of the standards, the first end of the barrier being mounted on the spool and at least partially wrapped about the spool;

wherein the slot in the base portion of the first standard is configured to receive the post portion of a second one of the primary and secondary standards so that the base portion of the first standard is restable upon the base portion of the second standard; and wherein the post portion of each of the standards includes a partial housing, the partial housing of one of the standards being configured to be received in the slot of the base portion of the other one of the standards such that the partial housing of one of the standards meets together with the partial housing of the other one of the standards to form a substantially enclosed housing with an interior.

17. The apparatus of claim 16 wherein the partial housing of the post portions of each of the standards is formed by a semi-cylindrical wall, the semi-cylindrical wall of the partial housing of the post portion of the primary standard and the semi-cylindrical wall of the partial housing of the post portion of the secondary standard forming a substantially cylindrical housing.

18. The apparatus of claim 16 wherein a handle is mounted on one of the partial housings of the standards.

19. The apparatus of claim 16 wherein a securing device is mounted on the partial housing of at least one of the post portion of at least one of the standards to releasably secure the partial housings of the post portions of the standards together.

* * * * *